US012747882B2

(12) United States Patent
Xiao et al.

(10) Patent No.: US 12,747,882 B2
(45) Date of Patent: Sep. 29, 2026

(54) REFRIGERANT LEAKAGE DETECTION METHOD AND DEVICE, AIR CONDITIONER AND STORAGE MEDIUM

(71) Applicants: MIDEA GROUP CO., LTD., Foshan (CN); GD MIDEA AIR-CONDITIONING EQUIPMENT CO., LTD., Foshan (CN)

(72) Inventors: Jiumin Xiao, Foshan (CN); Yancong Huang, Foshan (CN); Yang Xiao, Foshan (CN); Huifeng Liang, Foshan (CN); Yanpo Shao, Foshan (CN)

(73) Assignees: MIDEA GROUP CO., LTD., Foshan (CN); GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 379 days.

(21) Appl. No.: 18/517,768

(22) Filed: Nov. 22, 2023

(65) Prior Publication Data

US 2024/0085043 A1 Mar. 14, 2024

Related U.S. Application Data

(63) Continuation of application No. PCT/CN2022/094504, filed on May 23, 2022.

(30) Foreign Application Priority Data

May 27, 2021 (CN) ..... 202110589153.4

(51) Int. Cl.

| | |
|---|---|
| ***F24F 11/36*** | (2018.01) |
| ***F24F 11/86*** | (2018.01) |
| *F24F 110/10* | (2018.01) |

(52) U.S. Cl.

CPC ..... *F24F 11/36* (2018.01); *F24F 11/86* (2018.01); *F24F 2110/10* (2018.01)

(58) Field of Classification Search

CPC ..... F24F 11/36

See application file for complete search history.

(56) References Cited

U.S. PATENT DOCUMENTS

| | | | | |
|---|---|---|---|---|
| 2016/0265826 | A1* | 9/2016 | Liu | F25B 49/005 |
| 2019/0316800 | A1 | 10/2019 | Gao et al. | |
| 2021/0018200 | A1* | 1/2021 | Watanabe | F24F 11/62 |

FOREIGN PATENT DOCUMENTS

| | | | |
|---|---|---|---|
| CN | 105928156 | A | 9/2016 |
| CN | 106152428 | A | 11/2016 |

(Continued)

OTHER PUBLICATIONS

Supplementary European search report dated Nov. 11, 2024 received in European Patent Application No. 22810522.7.

(Continued)

*Primary Examiner* — Paul B Yanchus, III

(74) *Attorney, Agent, or Firm* — Scully, Scott, Murphy & Presser, P.C.

(57) ABSTRACT

Disclosed are a refrigerant leakage detection method and device, an air conditioner and a storage medium. The method includes: acquiring an exhaust temperature of an air conditioner at various moments during a preset time period, in response to the exhaust temperature of the air conditioner being greater than a preset exhaust temperature and a target operating exhaust parameter of the air conditioner exceeding a preset range of the exhaust parameter of refrigerant leakage; determining an extreme value of the exhaust temperature and an exhaust moment corresponding to the extreme value of the exhaust temperature of the air conditioner based on the exhaust temperature at various moments; acquiring an exhaust period of the air conditioner based on the exhaust (Continued)

moment; and determining whether there is the refrigerant leakage in the air conditioner based on the exhaust period.

9 Claims, 6 Drawing Sheets

(56) References Cited

FOREIGN PATENT DOCUMENTS

| | | | |
|---|---|---|---|
| CN | 110873434 | A | 3/2020 |
| CN | 110887165 | A | 3/2020 |
| CN | 110895024 | A | 3/2020 |
| CN | 111928448 | A | 11/2020 |
| JP | 2017020688 | A | 1/2017 |
| WO | 2017219230 | A1 | 12/2017 |

OTHER PUBLICATIONS

International Search Report and Written Opinion dated Aug. 4, 2022 received in International Application No. PCT/CN2022/094504.

* cited by examiner

REFRIGERANT LEAKAGE DETECTION METHOD AND DEVICE, AIR CONDITIONER AND STORAGE MEDIUM

CROSS-REFERENCE TO RELATED APPLICATIONS

This application is a continuation application of PCT International Application No. PCT/CN2022/094504, filed on May 23, 2022, which claims priority to and benefits of Chinese Patent Application No. 202110589153.4, filed on May 27, 2021, the entire contents of each of which are incorporated herein by reference for all purposes. No new matter has been introduced.

FIELD

The present application relates to the field of an air conditioner, and in particular, to a refrigerant leakage detection method, a refrigerant leakage detection device, an air conditioner and a storage medium.

BACKGROUND

At present, two types of detection methods are generally used to detect refrigerant leakage in air conditioners. One type is to add a certain component to a refrigerant/refrigerating fluid and detect the concentration of this component to determine whether the refrigerant is leaking. The other type is to detect parameters such as exhaust, return air and pressure after a certain period of operation to determine whether there is refrigerant leakage.

However, when the two detection methods are used to detect the refrigerant, adding components to the refrigerant can affect heat transfer characteristics and specialized equipment is required for detection, which is costly. If the parameters such as exhaust, return air, and pressure are detected and can fluctuate with various frequency limiting values triggered after the refrigerant leakage, and this fluctuation period is uncertain, thereby affecting the detection accuracy of the refrigerant leakage.

SUMMARY

The present application provides a refrigerant leakage detection method, a refrigerant leakage detection device, an air conditioner and a storage medium, aiming to at least solve the technical problem that the operating parameters of the air conditioner can fluctuate with various frequency limiting values triggered after refrigerant leakage, thereby affecting the detection accuracy of the refrigerant leakage.

In order to achieve the above purpose, the present application provides a refrigerant leakage detection method, including:

acquiring an exhaust temperature of an air conditioner at various moments during a preset time period, in response to the exhaust temperature of the air conditioner being greater than a preset exhaust temperature and a target operating exhaust parameter of the air conditioner exceeding a preset range of the exhaust parameter of refrigerant leakage;

determining an extreme value of the exhaust temperature and an exhaust moment corresponding to the extreme value of the exhaust temperature of the air conditioner based on the exhaust temperature at various moments;

acquiring an exhaust period of the air conditioner based on the exhaust moment; and determining whether there is the refrigerant leakage in the air conditioner based on the exhaust period.

In an embodiment, the step of determining the extreme value of the exhaust temperature of the air conditioner based on the exhaust temperature at various moments includes:

determining an exhaust difference value between the exhaust temperatures at two adjacent moments; and determining the extreme value of the exhaust temperature of the air conditioner based on the exhaust difference value.

In an embodiment, the step of determining whether there is the refrigerant leakage in the air conditioner based on the exhaust period further includes:

determining that there is a first-level refrigerant leakage in the air conditioner, in response to the exhaust period of the exhaust temperature being less than a preset exhaust period; and determining that there is a second-level refrigerant leakage in the air conditioner, in response to the exhaust period of the exhaust temperature being greater than or equal to the preset exhaust period.

In an embodiment, after the step of determining that there is a second-level refrigerant leakage in the air conditioner, the method further includes: decreasing an operating frequency of the compressor of the air conditioner and increasing an opening of an outdoor electronic expansion valve of the air conditioner.

In an embodiment, after the step of decreasing the operating frequency of the compressor of the air conditioner and increasing the opening of the outdoor electronic expansion valve of the air conditioner, the method further includes: controlling the air conditioner to restart, and acquiring the target operating exhaust parameters of the air conditioner; and controlling the compressor of the air conditioner to shut down and outputting a refrigerant leakage prompt message, when it is detected that the target operating exhaust parameters exceed a preset parameter range of refrigerant leakage detection.

In an embodiment, after the step of acquiring the target operating exhaust parameter of the air conditioner, the method further includes:

decreasing the operating frequency of the compressor of the air conditioner and increasing the opening of the outdoor electronic expansion valve of the air conditioner, when it is detected that the target operating exhaust parameter does not exceed the preset parameter range of the refrigerant leakage detection.

In an embodiment, after the step of determining that there is the first-level refrigerant leakage in the air conditioner, the method further includes: controlling the compressor of the air conditioner to stop and outputting a refrigerant leakage prompt message.

In an embodiment, the step of acquiring the exhaust temperature of the air conditioner at various moments during the preset time period, in response to the exhaust temperature of the air conditioner being greater than the preset exhaust temperature and the target operating exhaust parameter of the air conditioner exceeding the preset range of the exhaust parameter of refrigerant leakage includes:

adjusting an operation state of the air conditioner and acquiring the target operating exhaust parameter of the air conditioner operated in the adjusted operation state, in response to that the exhaust temperature of the air conditioner is greater than the preset exhaust temperature; and acquiring the exhaust temperature of the air conditioner at various moments during the preset time period, in response to the target operating exhaust parameter of the air conditioner exceeding the preset range of the exhaust parameter of refrigerant leakage.

In order to achieve the above objective, the present application further provides the refrigerant leakage detection device, including:

a first acquisition module, configured to acquire an exhaust temperature of an air conditioner at various moments during a preset time period, in response to the exhaust temperature of the air conditioner being greater than a preset exhaust temperature and a target operating exhaust parameter of the air conditioner exceeding a preset range of the exhaust parameter of refrigerant leakage;

a first determination module, configured to determine an extreme value of the exhaust temperature and an exhaust moment corresponding to the extreme value of the exhaust temperature of the air conditioner based on the exhaust temperature at various moments;

a second acquisition module, configured to acquire an exhaust period of the air conditioner based on the exhaust moment; and a second determination module, configured to determine whether there is a refrigerant leakage in the air conditioner based on the exhaust period.

In addition, in order to achieve the above objective, the present application further provides an air conditioner, including one or more processors, a memory and a refrigerant leakage detection program stored in the memory, the steps of the refrigerant leakage detection method as described above are implemented when the refrigerant leakage detection program is executed by the one or more processors.

In addition, in order to achieve the above objective, the present application further provides a computer-readable storage medium, a refrigerant leakage detection program is stored on the computer-readable storage medium, and the steps of the refrigerant leakage detection method as described above are implemented when the refrigerant leakage detection program is executed by one or more processors.

Compared with the existing technology, the present application provides a refrigerant leakage detection method, including: acquiring the exhaust temperature of the air conditioner at various moments during the preset time period, in response to the exhaust temperature of the air conditioner being greater than the preset exhaust temperature and the target operating exhaust parameter of the air conditioner exceeding the preset range of the exhaust parameter of refrigerant leakage; determining the extreme value of the exhaust temperature and the exhaust moment corresponding to the extreme value of the exhaust temperature of the air conditioner based on the exhaust temperature at various moments; acquiring the exhaust period of the air conditioner based on the exhaust moment; and determining whether there is a refrigerant leakage in the air conditioner based on the exhaust period. Therefore, an accurate exhaust period is obtained by determining the extreme value of the exhaust temperature and the exhaust moment corresponding to the extreme value of the exhaust temperature of the air conditioner, thereby reducing false alarms of refrigerant leakage based on the accurate exhaust period and improving the detection accuracy of refrigerant leakage.

The realization of the purpose, functional features and advantages of the present application will be further described in conjunction with the embodiments and with reference to the accompanying drawings.

DETAILED DESCRIPTION OF EMBODIMENTS

It should be understood that the specific embodiments described here are only used to explain the present application, and are not intended to limit the present application.

Figure 1:
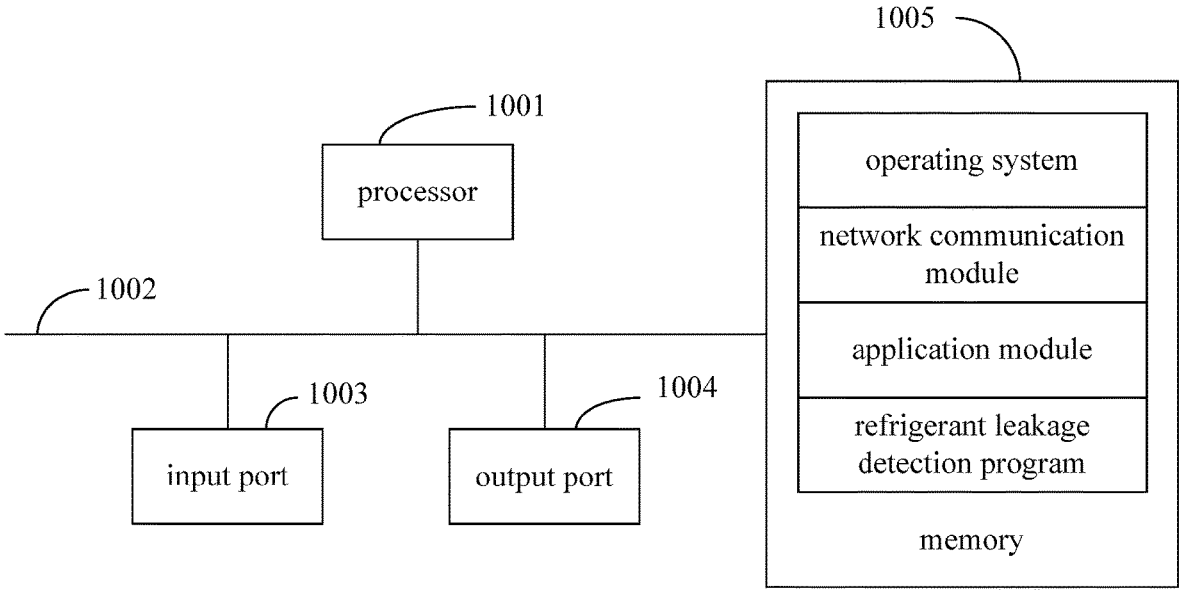
FIG. 1 is a schematic diagram of a hardware structure of an air conditioner according to various embodiments of the present application.

As shown in FIG. 1, FIG. 1 is a schematic diagram of a hardware structure of an air conditioner according to various embodiments of the present application. In the embodiments of the present application, the air conditioner may include at least one processor 1001 (such as, a central processing unit, CPU), a communication bus 1002, an input port 1003, an output port 1004 and a memory 1005. The communication bus 1002 is used to realize connection communication between these components, the input port 1003 is used for data input, the output port 1004 is used for data output, and the memory 1005 can be a high-speed Random Access Memory (RAM) memory or a stable memory, such as disk memory. Alternatively, the memory 1005 may also be a storage device independent of the foregoing processor 1001. Those skilled in the art can understand that the hardware structure shown in FIG. 1 does not limit the present application, and may include more or fewer components than shown, or a combination of certain components, or differently arranged components.

As shown in FIG. 1, the memory 1005 as a computer-readable storage medium in FIG. 1 may include an operating system, a network communication module, an application module, and a refrigerant leakage detection program. In a terminal shown in FIG. 1, the output port 1004 can be a network port and is mainly used to connect to a back-end server and perform data communication with the back-end server, the input port 1003 can be a user port and is mainly used to connect to an client (user side) and perform the data communication with the client, and the processor 1001 can be used to call the refrigerant leakage detection program stored in the memory 1005.

In this embodiment, the refrigerant leakage detection device includes: the memory 1005, the processor 1001, and the refrigerant leakage detection program stored on the memory 1005 and executable on the processor 1001. When the processor 1001 calls the refrigerant leakage detection program stored in the memory 1005, the following steps are performed:

acquiring an exhaust temperature of the air conditioner at various moments during a preset time period, in response to the exhaust temperature of the air conditioner being greater than a preset exhaust temperature and a target operating exhaust parameter of the air conditioner exceeding a preset range of the exhaust parameter of the refrigerant leakage;

determining an extreme value of the exhaust temperature of the air conditioner and an exhaust moment corresponding to the extreme value of the exhaust temperature based on the exhaust temperature at various moments;

acquiring an exhaust period of the air conditioner based on the exhaust moment; and determining whether there is refrigerant leakage in the air conditioner based on the exhaust period.

Figure 2:
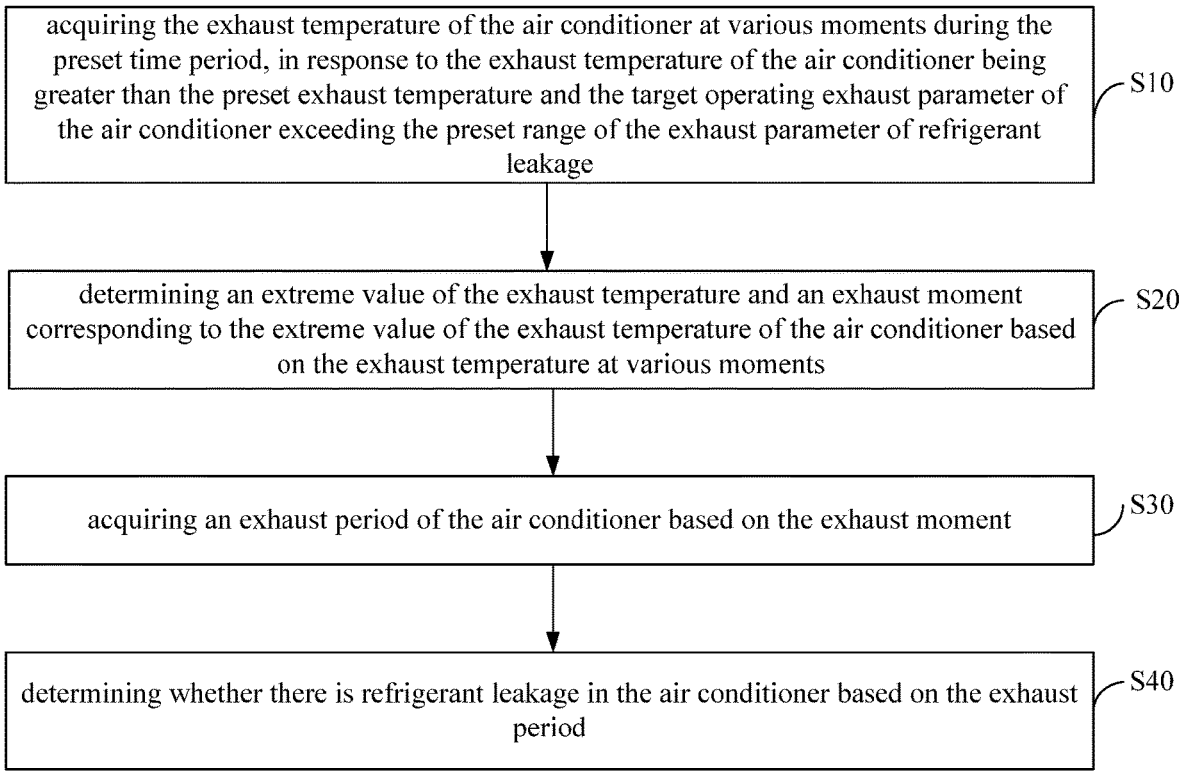
FIG. 2 is a schematic flowchart of a refrigerant leakage detection method according to a first embodiment of the present application.

Based on the hardware structure shown in FIG. 1, the first embodiment of the present application provides the refrigerant leakage detection method. As shown in FIG. 2, FIG. 2 is a schematic flowchart of the refrigerant leakage detection method according to a first embodiment of the present application.

The embodiment of the present application provides an embodiment of the refrigerant leakage detection method. It should be noted that although the logical order is shown in the flowchart, in some cases, the steps shown or described may be performed in a different order than here.

For example, as shown in FIG. 2, the refrigerant leakage detection method in this embodiment includes:

step S10, acquiring the exhaust temperature of the air conditioner at various moments during the preset time period, in response to the exhaust temperature of the air conditioner being greater than the preset exhaust temperature and the target operating exhaust parameter of the air conditioner exceeding the preset range of the exhaust parameter of refrigerant leakage.

For example, in this embodiment, the above-mentioned preset exhaust temperature refers to the temperature used to measure whether the exhaust temperature is abnormal during exhaust detection. The preset exhaust temperature can be a specific exhaust temperature threshold preset by a user. When it is detected that the current exhaust temperature exceeds the specific exhaust temperature threshold preset by the user, it indicates that the exhaust temperature of the air conditioner exceeds the exhaust temperature of the air conditioner during normal operation, and it is determined that the air conditioner needs to perform refrigerant leakage protection, for example, a refrigerant leakage protection module is automatically activated to perform the refrigerant leakage protection. In addition, due to different performance parameters of the air conditioner and operating conditions of the air conditioner under different operating parameters, adopting the specific exhaust temperature threshold may lead to inaccurate exhaust detection, which in turn affects inaccurate refrigerant leakage detection. Therefore, in this embodiment, it is possible to flexibly set the exhaust temperature threshold for the air conditioner based on the current operating parameters, thereby improving the accuracy of exhaust detection. The operating parameters can be any parameter such as compression ratio, refrigerant flow rate and electronic expansion valve opening that can affect the exhaust temperature and are not limited in this embodiment.

In addition, in order to avoid damage to a compressor of the air conditioner, in this embodiment, when it is detected that the exhaust temperature of the air conditioner is greater than the preset exhaust temperature, the operating state of the air conditioner is adjusted. For example, in this embodiment, the air conditioner is first controlled to shut down, after it is detected that the exhaust temperature of the air conditioner is within the normal range of the exhaust temperature, the air conditioner is controlled to start and run, thereby controlling the air conditioner to restart and run to avoid damage to the compressor of the air conditioner. While the air conditioner is controlled to start and run, outdoor and indoor fans of the air conditioner are controlled to run at the highest speed, thereby completing the adjustment of the operating state of the air conditioner.

Next, after the outdoor and indoor fans of the air conditioner run at the highest speed for a certain time period, the target operating exhaust parameters of the air conditioner operating in the adjusted operating state are acquired, thereby avoiding fluctuations in operating parameters such as exhaust temperature caused by unstable operation of the air conditioner in the early stage of restarting the air conditioner, which in turn leads to inaccurate detection results. In addition, it should be noted that in this embodiment, by adjusting the operating state of the air conditioner, the exhaust temperature of the air conditioner and the ambient temperature of the environment in which the air conditioner is located are driven to change. Only if it is detected that the target operating exhaust parameters exceed the preset range of the exhaust parameter of refrigerant leakage again after the exhaust temperature of the air conditioner and the ambient temperature of the environment in which the air conditioner is located have changed, it can be determined that there is refrigerant leakage in the air conditioner, thereby reducing the misjudgment rate of refrigerant leakage.

Furthermore, in this embodiment, when the target operating exhaust parameters of the air conditioner exceed the preset range of the exhaust parameter of refrigerant leakage, the exhaust temperature of the air conditioner at various moments during the preset time period is acquired, and the level of refrigerant leakage using the exhaust temperature at various moments is determined, thereby improving the accuracy of refrigerant leakage detection.

In addition, it should be noted that the above target operating exhaust parameters refer to the exhaust temperature of the compressor and the running current of the air conditioner. In this implementation, the exhaust temperature of the compressor and the running current of the air conditioner are detected to detect whether the air conditioner needs to trigger the refrigerant leakage detection function. In other words, in this embodiment, when it is detected that the exhaust temperature is greater than the exhaust temperature threshold and the running current is less than an running current threshold, that is, when the preset range of the exhaust parameter of refrigerant leakage is exceeded, it indicates that the air conditioner is operating abnormally, and it is determined that there is refrigerant leakage in the air conditioner, that is, the air conditioner needs to trigger the refrigerant leakage detection function; otherwise, it indicates that the air conditioner is operating normally, and it is determined that the air conditioner does not need to trigger the refrigerant leakage detection function.

When it is detected that the air conditioner needs to trigger the refrigerant leakage detection function, the preset refrigerant leakage detection process is executed, that is, the exhaust temperature at various moments during the preset time period is first acquired, and the preset refrigerant leakage detection process is completed based on the exhaust temperature at various moments.

In this embodiment, when acquiring the exhaust temperature at various moments, a timing acquisition method is adopted. The time can be started after it is detected that the above parameters exceed the preset range of the exhaust parameter of refrigerant leakage. In addition, the time can also be started after it is detected that the exhaust temperature is greater than the preset exhaust temperature. For example, after it is detected that the exhaust temperature is greater than the preset exhaust temperature, the exhaust temperature of the compressor and the running current of the air conditioner are detected every one second. After it is detected that the exhaust temperature is greater than the exhaust temperature threshold and the running current is less than the running current threshold, the refrigerant leakage detection function is triggered, and the current exhaust temperature of the air conditioner is continued to acquire. Accumulating the time continues, for example, the i-th second, and then sequentially acquiring the exhaust temperature at the (i+1)th second, (i+2)th second, and so on. The time interval for timing acquisition can be any time and is not limited in this embodiment.

Step S20, determining an extreme value of the exhaust temperature and an exhaust moment corresponding to the extreme value of the exhaust temperature of the air conditioner based on the exhaust temperature at various moments.

Step S30, acquiring an exhaust period of the air conditioner based on the exhaust moment.

For example, the above extreme value of the exhaust temperature refers to the highest exhaust temperature or the lowest exhaust temperature during the exhaust temperature fluctuation period. For example, the exhaust temperature detected at the 152nd second is 123° C., and the exhaust temperature detected at the 153 rd second is 124° C., 124° C. is the highest exhaust temperature.

In this embodiment, after obtaining the exhaust temperature at various moments, the extreme value of the exhaust temperature can be determined based on an exhaust difference value between the exhaust temperatures at two adjacent moments. For example, by determining the exhaust difference value between the exhaust temperature at the (i+1)th second and the exhaust temperature at the i-th second, it is possible to find the highest exhaust temperature or the lowest exhaust temperature and the exhaust moment corresponding to thereof. For example, after obtaining the exhaust temperature at various moments, if the exhaust difference value between the exhaust temperatures of two adjacent moments acquired for the first time is greater than zero, continue to acquire the exhaust difference value between the exhaust temperatures of the two subsequent adjacent moments until the exhaust difference value is equal to or less than zero, thus obtaining the highest exhaust temperature, and determining the exhaust moment corresponding to the highest exhaust temperature. If the exhaust difference value acquired for the first time is less than zero, continue to acquire the exhaust difference value between the exhaust temperatures at two subsequent adjacent moments until the exhaust difference value is equal to or greater than zero, thus obtaining the lowest exhaust temperature, and determining the exhaust moment corresponding to the lowest exhaust temperature.

For ease of understanding, here is an example of the above steps. For example, after the exhaust temperature detected at the 152nd s is 123° C. and the exhaust temperature detected at the 153rd s is 124° C., the exhaust difference value between the 153rd s and the 152nd s is calculated as 1° C. Next, the exhaust temperature detected at the 154th s is 126° C., and the exhaust difference value between the 154th s and the 153rd s is calculated as 2° C. Next, the exhaust temperature detected at the 155th s is 125° C., and the exhaust difference value between the 155th s and the 154th s is calculated as (−1) ° C., which means that the highest exhaust temperature during the fluctuation period of the exhaust temperature is 126° C., and the exhaust moment corresponding to thereof is 154th s.

In addition, it should be noted that in this embodiment, it is necessary to acquire at least two highest exhaust temperatures or lowest exhaust temperatures to acquire the exhaust period. Here, the highest exhaust temperature is described as an example. When the exhaust difference value is acquired for the first time is greater than zero, continue to acquire the exhaust difference value between the exhaust temperatures at two subsequent adjacent moments until the exhaust difference value is equal to or less than zero, thereby obtaining a first highest exhaust temperature, and determining a first exhaust moment corresponding to the first highest exhaust temperature. Next, it continues to execute the above steps repeatedly, that is, after acquiring the first highest exhaust temperature, continue to acquire the exhaust difference value between the exhaust temperatures at the two subsequent adjacent moments until a second highest exhaust temperature is obtained based on the exhaust difference value, and a second exhaust moment corresponding to the second highest exhaust temperature is determined. In addition, it should be noted that the exhaust temperature is flexibly variable, thus the highest exhaust temperature and the lowest exhaust temperature in each exhaust period are not a fixed value. Therefore, in this embodiment, the temperature values of the first highest exhaust temperature and the second highest exhaust temperature may be the same, or may be different. Finally, a time difference value between the first exhaust moment and the second exhaust moment is calculated to obtain the exhaust period.

In addition, in this embodiment, in addition to determining the extreme value of the exhaust temperature based on the exhaust difference value, an exhaust temperature trend curve of the air conditioner can also be generated based on the exhaust temperature at various moments, and the extreme value of the exhaust temperature can be determined based on the exhaust temperature trend curve.

Step S40: determining whether there is refrigerant leakage in the air conditioner based on the exhaust period.

In this embodiment, the above exhaust period can be used to reduce false alarms of refrigerant leakage types, thereby improving the accuracy of the refrigerant leakage.

Figure 3:
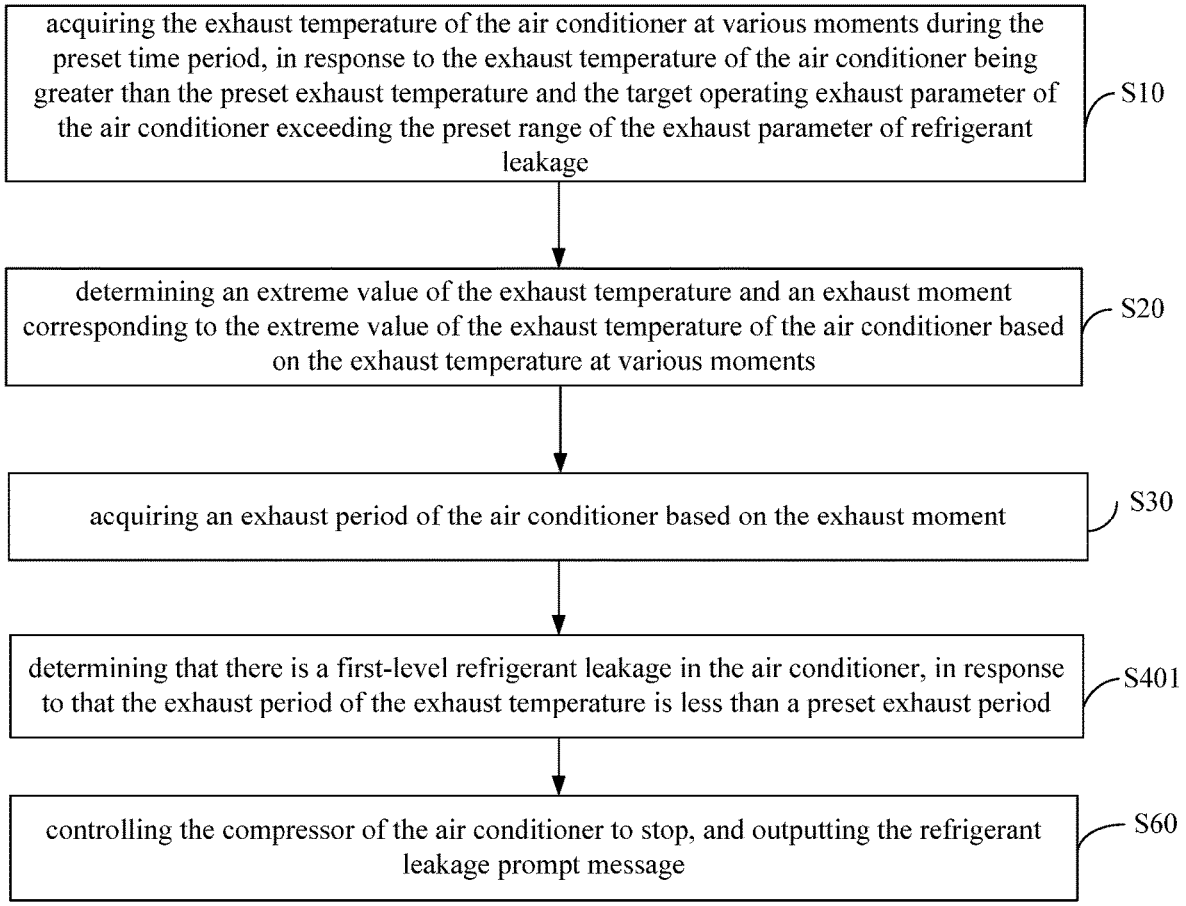
FIG. 3 is another schematic flowchart of the refrigerant leakage detection method according to the first embodiment of the present application.

For example, as shown in FIG. 3, the above-mentioned step S40 in this embodiment also includes:

step S401: determining that there is a first-level refrigerant leakage in the air conditioner, in response to the exhaust period of the exhaust temperature being shorter than a preset exhaust period; and step S402: determining that there is a second-level refrigerant leakage in the air conditioner, in response to the exhaust period of the exhaust temperature being longer than or equal to the preset exhaust period.

It should be noted that the second-level refrigerant leakage refers to the possible slight refrigerant leakage in the current air conditioner. Therefore, if there is the second-level refrigerant leakage in the air conditioner, the operating parameters of the air conditioner can be adjusted to enable the air conditioner to still have a certain cooling or heating effect, so as to not affect the normal use of the air conditioner. The first-level refrigerant leakage refers to there is a relatively serious refrigerant leakage in the current air conditioner and can affect the normal operation of the air conditioner. Therefore, if there is the first-level refrigerant leakage in the air conditioner, it is necessary to immediately control the compressor of the air conditioner to shut down so as to protect the compressor and other equipment. In addition, a refrigerant leakage prompt message can also be output to remind the user.

It should be understood that the above are only examples and do not constitute any limitation on the technical solution of the present application. Those skilled in the art can make adaptive changes in practical applications without departing from the essence of the present disclosure, which is not described herewith for brevity.

In this embodiment, after it is detected that the air conditioner needs to trigger the refrigerant leakage detection function, the exhaust temperature of the air conditioner at various moments is acquired to determine the extreme value of the exhaust temperature of the air conditioner and the exhaust moment corresponding to thereof, thereby determining the exhaust period and detecting the refrigerant leakage based on the exhaust period. Therefore, the accurate exhaust period is obtained by determining the extreme value of the exhaust temperature of the air conditioner and the exhaust moment corresponding to thereof, and it is possible to reduce the false alarms for refrigerant leakage based on the accurate exhaust period, thereby improving the detection accuracy of refrigerant leakage.

Furthermore, based on the refrigerant leakage detection method according to the first embodiment of the present application, a refrigerant leakage detection method according to a second embodiment of the present application is proposed.

As shown in FIG. 3, FIG. 3 is a schematic flow chart of the refrigerant leakage detection method according to the second embodiment of the present application.

The difference between the second embodiment and the first embodiment is that after step S402, it also includes:

step S50: decreasing an operating frequency of the compressor of the air conditioner and increasing an opening of an outdoor electronic expansion valve of the air conditioner.

In this embodiment, when the exhaust period of the air conditioner is detected to be relatively large, it indicates that the current refrigerant leakage is not too serious, that is, the current refrigerant leakage does not affect the normal operation of the air conditioner. Therefore, the operating parameters of the air conditioner can be adjusted to allow the air conditioner to still have a certain cooling or heating effect without affecting the normal use of the air conditioner.

It should be noted that in this embodiment, when the operating frequency of the air conditioner and the opening of the electronic expansion valve are adjusted, in order to reduce an operating load of the air conditioner, the operating frequency can be directly decreased to a first preset operating frequency, or the opening of the electronic expansion valve can be directly increased to a first preset opening.

In addition, in order to maintain the stability of an indoor temperature and avoid excessive adjustment of the operating frequency of the air conditioner and the opening of the electronic expansion valve, which can lead to excessive fluctuations in the indoor temperature and affect user comfort, in this embodiment, adjustment range for the operating frequency of the air conditioner and the opening of the electronic expansion valve can also be determined based on a temperature range of the current outdoor temperature. For example, the outdoor temperature is divided into three temperature ranges: $a \le T < b$, $b \le T < c$, $c \le T \le d$, where when $a \le T < b$, the adjustment range of the operating frequency is $-f1$ (i.e., decrease f1), and the adjustment range of the opening of the electronic expansion valve is P1 (i.e., increase P1); when $b\ T < c$, the adjustment range of the operating frequency is $-f2$, and the adjustment range of the opening of the electronic expansion valve is P2; when $c \le T \le d$, the adjustment range of the operating frequency is $-f3$, and the adjustment range of the opening of the electronic expansion valve is P3, where $f1 < f2 < f3$ and $P1 < P2 < P3$, that is, the higher the outdoor temperature, the greater the decrease in the operating frequency of the air conditioner, and the greater the increase in the opening of the electronic expansion valve.

In addition, it should be noted that in order to ensure the normal operation of the air conditioner, generally, the operating frequency of the air conditioner has a minimum limited operating frequency, and the opening of the electronic expansion valve has a maximum limited opening. Therefore, in this embodiment, during adjusting the operating frequency of the air conditioner and the opening of the electronic expansion valve, when the operating frequency after decreasing is lower than the minimum limited operating frequency, the air conditioner is controlled to operate at the minimum limited operating frequency; and when the opening of the electronic expansion valve after increasing is greater than the maximum limited opening, the air conditioner is controlled to run at the maximum limited opening.

In order to avoid not detecting the refrigerant leakage due to small fluctuations in parameters such as the exhaust temperature triggered in the early stage of refrigerant leakage, in this embodiment, after adjusting the operating frequency of the air conditioner and the opening of the electronic expansion valve, the air conditioner is controlled to restart and run. For example, in this embodiment, the air conditioner is first controlled to shut down, and after it is detected that the exhaust temperature of the air conditioner is within the normal range of the exhaust temperature, the air conditioner is controlled to start and run, and target operating exhaust parameters of the air conditioner are acquired. It should be noted that the above target operating exhaust parameters refer to the exhaust temperature of the compressor and a running current of the air conditioner. In this embodiment, the exhaust temperature of the compressor and the running current of the air conditioner are detected to detect whether there is a serious first-level refrigerant leakage in the air conditioner. When it is detected that the exhaust temperature is higher than an exhaust temperature threshold and the running current is lower than a running current threshold, that is, when the target operating exhaust parameters are beyond a preset parameter range for refrigerant leak detection, it is determined that there is a serious first-level refrigerant leak in the air conditioner. Therefore, in order to protect the compressor and other equipment of the air conditioner, the compressor of the air conditioner is controlled to stop, and a refrigerant leakage prompt message is output based on a display screen of the air conditioner to remind the user of the need for the air conditioner maintenance. On the contrary, when it is detected that the target operating exhaust parameters are not beyond the preset parameter range for refrigerant leakage detection, it is determined that there is no serious first-level refrigerant leak in the air conditioner at present, indicating that the refrigerant leakage does not significantly affect the normal operation of the air conditioner at present. Therefore, the operating parameters of the air conditioner can be adjusted to allow the air conditioner to still have a certain cooling or heating effect without affecting the normal use of the air conditioner. For example, in this embodiment, the operating frequency of the compressor of the air conditioner is decreased, and the opening of the outdoor electronic expansion valve of the air conditioner is increased.

It should be noted that in this embodiment, during adjusting the operating frequency of the air conditioner and the opening of the electronic expansion valve, in order to reduce the operating load of the air conditioner, the operating frequency can be directly decreased to a second preset operating frequency, or the opening of the electronic expansion valve can be increased directly increase to a second preset opening. The second operating frequency is lower than the above-mentioned first operating frequency, and the second opening is greater than the above-mentioned first opening.

In addition, in order to maintain the stability of the indoor temperature and avoid excessive adjustment of the operating frequency of the air conditioner and the opening of the electronic expansion valve, which can lead to excessive fluctuations in the indoor temperature and affect user comfort, in this embodiment, the adjustment range for the operating frequency of the air conditioner and the opening of the electronic expansion valve can also be determined based on the temperature range of the current outdoor temperature, which is not limited in this embodiment.

In this embodiment, when it is detected that the current refrigerant leakage is not too serious, that is, the current refrigerant leakage basically does not affect the normal operation of the air conditioner, the operating parameters of the air conditioner can be adjusted to allow the air conditioner to still have a certain cooling or heating function without affecting the normal use of the air conditioner.

Furthermore, based on the first embodiment of the detection method for the refrigerant leakage of the present application, a third embodiment of the detection method for the refrigerant leakage of the present application is proposed.

Figure 4:
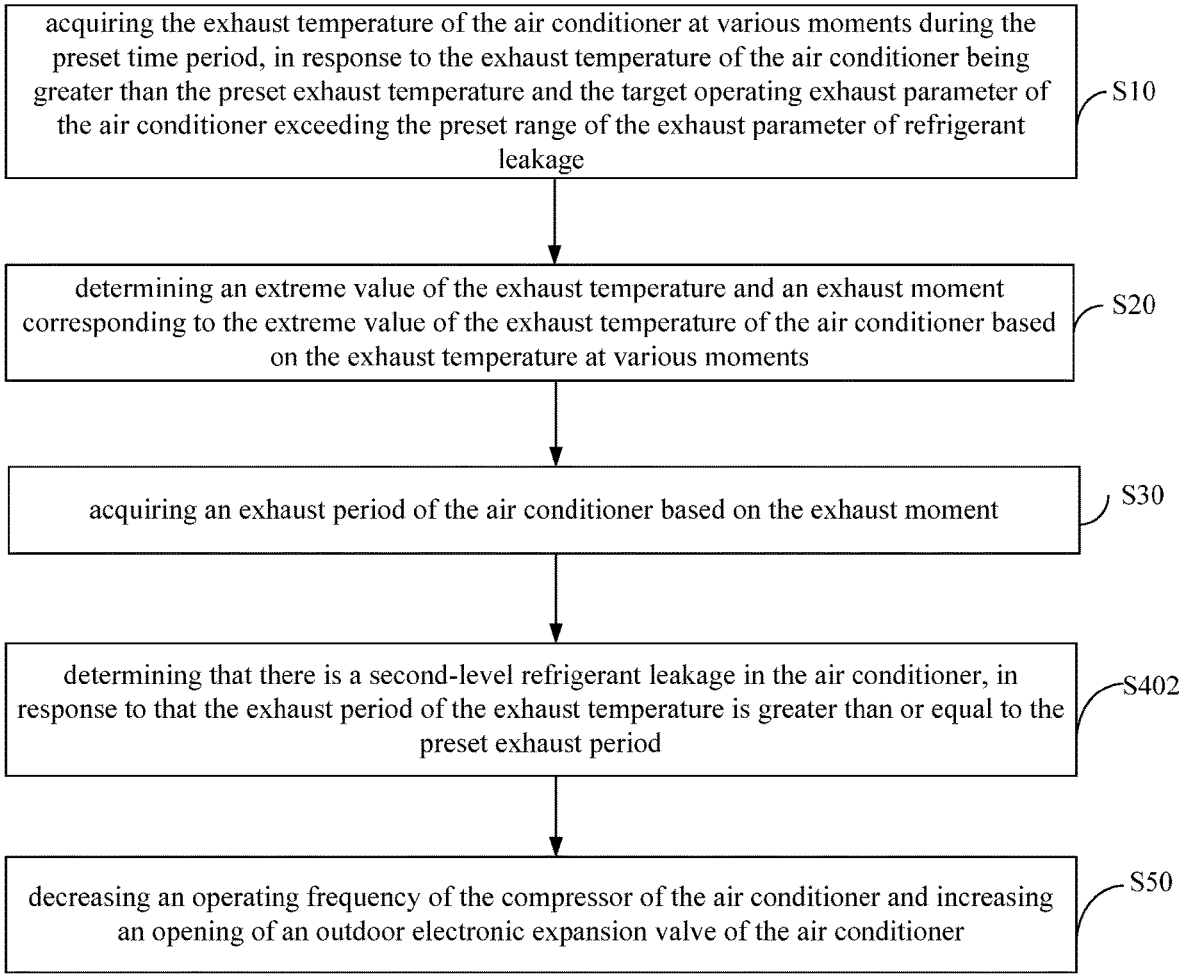
FIG. 4 is a schematic flowchart of the refrigerant leakage detection method according to a second embodiment of the present application.

As shown in FIG. 4, FIG. 4 is a schematic flow chart of the refrigerant leakage detection method according to a third embodiment of the present application.

The difference between the third embodiment and the first embodiment is that after step S401, it also includes:

step S60: controlling the compressor of the air conditioner to stop, and outputting the refrigerant leakage prompt message.

In this embodiment, when it is detected that the exhaust period of the air conditioner is small, it indicates that the current refrigerant leakage is relatively serious. In order to protect the compressor and other equipment of the air conditioner, it is necessary to immediately control the compressor to stop running and output corresponding prompt messages based on the display screen of the air conditioner to remind the user of the need for the air conditioner maintenance.

In addition, in order to avoid damage to the compressor and other equipment of the air conditioner caused by the user restarting the air conditioner again, in this embodiment, a protection module of the air conditioner protection module is automatically started after the compressor is controlled to stop running. That is, before the refrigerant leakage of the air conditioner is repaired, when receiving the control command sent by the user, the operation corresponding to the control command is not executed, and the corresponding prompt message is output based on the display screen of the air conditioner again to prompt that the air conditioner is faulty and cannot operate normally.

In this embodiment, when a serious refrigerant leakage is detected, the compressor is immediately controlled to stop running to protect the compressor and other equipment of the air conditioner, and the corresponding prompt message is output based on the display screen of the air conditioner to prompt the user that the air conditioner needs to repair.

Figure 5:
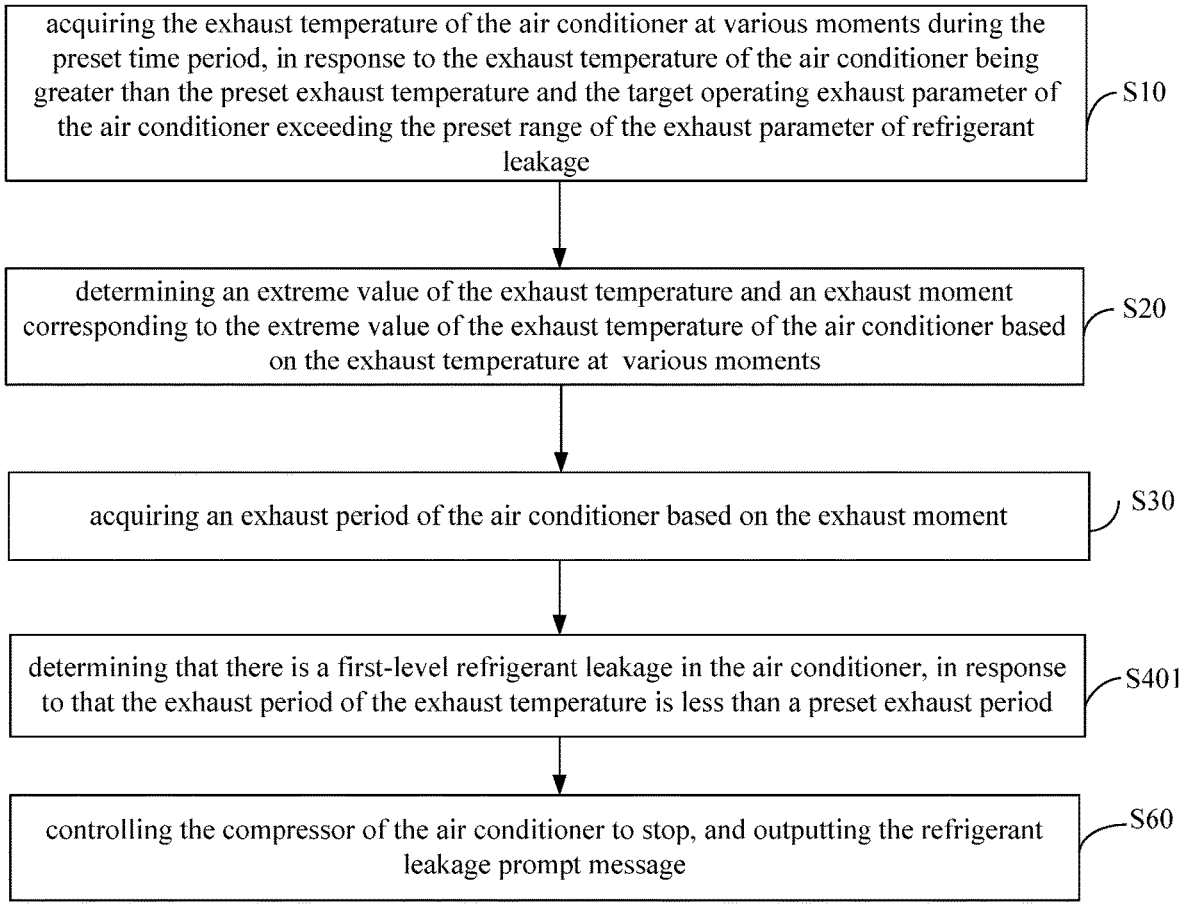
FIG. 5 is a schematic flowchart of the refrigerant leakage detection method according to a third embodiment of the present application.
Figure 6:
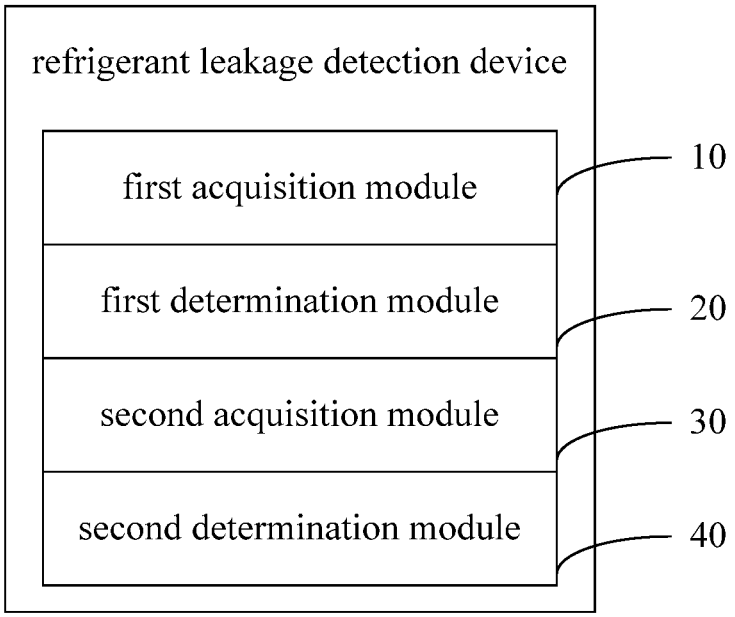
FIG. 6 is a schematic diagram of functional modules of a refrigerant leakage detection device according to an embodiment of the present application.

In addition, this embodiment also provides a detection device for the refrigerant leakage. As shown in FIG. 5, FIG. 5 is a schematic diagram of functional modules of the refrigerant leakage detection device according to an embodiment of the present application.

For example, as shown in FIG. 5, the refrigerant leakage detection device includes: an acquisition module 10, a first determination module 20, a second acquisition module 30, and a second determination module 40.

The acquisition module 10 is configured to acquire the exhaust temperature of the air conditioner at various moments during a preset time period, in response to the exhaust temperature of the air conditioner being greater than the preset exhaust temperature and the target operating exhaust parameter of the air conditioner exceeding the preset range of the exhaust parameters of the refrigerant leakage.

For example, in this embodiment, the above-mentioned preset exhaust temperature refers to the temperature used to measure whether the exhaust temperature is abnormal during exhaust detection, in which the preset exhaust temperature can be a specific exhaust temperature threshold preset by the user. When it is detected that the current exhaust temperature exceeds the specific exhaust temperature threshold preset by the user, it indicates that the exhaust temperature of the air conditioner exceeds the exhaust temperature of the air conditioner during normal operation, and it is determined that the air conditioner needs to be protected against the refrigerant leakage, such as automatically activating the protection module for the refrigerant leakage for refrigerant leakage protection. In addition, since the performance parameters of the air conditioners and the operating status of the air conditioner under each operating parameter are different, if the specific exhaust temperature threshold is used, it may lead to inaccurate exhaust detection, which in turn affects the inaccurate refrigerant leakage detection. Therefore, in the embodiment, the exhaust temperature threshold can also be flexibly set for the air conditioner according to the current operating parameters, thereby improving the accuracy of exhaust detection. The operating parameters can be any parameter that can affect the exhaust temperature such as a compression ratio, a refrigerant flow rate, the opening of the electronic expansion valve and the like and are not limited in this embodiment.

In addition, in order to avoid damage to the compressor of the air conditioner, in this embodiment, when it is detected that the exhaust temperature of the air conditioner is greater than the preset exhaust temperature, the operating status of the air conditioner is adjusted. For example, in this embodiment, the air conditioner is first controlled to shut down, and after it is detected that the exhaust temperature of the air conditioner is within the normal range of the exhaust temperature, the air conditioner is controlled to start operation, thereby controlling the air conditioner to restart operation to avoid damage to the compressor of the air conditioner, and while the air conditioner is started and running, outdoor and indoor fans of the air conditioner are controlled to run at the highest speed, thereby completing the adjustment of the operating status of the air conditioner.

After the outdoor and indoor fans of the air conditioner run at the highest speed for a certain time period, the target operating exhaust parameters are acquired when the air conditioner operates in the adjusted operating state, thereby avoiding fluctuations in the operating parameters such as the exhaust temperature caused by unstable operation of the air conditioner in the early stage of restarting the air conditioner, which in turn leads to inaccurate detection results. In addition, it should be noted that in this embodiment, by adjusting the operating status of the air conditioner, the exhaust temperature of the air conditioner and the ambient temperature of the environment where the air conditioner is located are changed. If it is detected again that the target operating exhaust parameters exceed the preset range of the exhaust parameter of the refrigerant leakage after the exhaust temperature of the air conditioner and the ambient temperature of the environment where the air conditioner is located are changed, it can be determined that the refrigerant leakage of the air conditioner occurs, and it is possible to reduce the misjudgment rate of the refrigerant leakage.

Furthermore, in this embodiment, when the target operating exhaust parameters of the air conditioner exceed the preset range of the exhaust parameter of the refrigerant leakage, the exhaust temperatures of the air conditioner at various moments during the preset time period is acquired, thereby determining the level of the refrigerant leakage by the exhaust temperature at various moments, and improving the accuracy of refrigerant leakage detection.

In addition, it should be noted that the above target operating exhaust parameters refer to the exhaust temperature of the compressor and the running current of the air conditioner. In this embodiment, the exhaust temperature of the compressor and the running current of the air conditioner are detected to detect whether the air conditioner needs to trigger the refrigerant leakage detection function. In other words, in this embodiment, when it is detected that the exhaust temperature is greater than the exhaust temperature threshold and the running current is lower than the running current threshold, i.e., exceeding the above-mentioned preset range of the exhaust parameter of the refrigerant leakage, it indicates that the air conditioner is operating abnormally, and it is determined that there is the refrigerant leakage in the air conditioner. That is, the air conditioner needs to trigger the refrigerant leak detection function. Otherwise, it indicates that the air conditioner is operating normally, and it is determined that the air conditioner does not need to trigger the refrigerant leak detection function.

When it is detected that the air conditioner needs to trigger the refrigerant leakage detection function, a preset detection process for the refrigerant leakage is executed, that is, the exhaust temperature at various moments during the preset time period is first acquired, and the preset detection process for the refrigerant leakage is completed based on the exhaust temperature at various moments.

In this embodiment, when acquiring the exhaust temperature at various moments, a timing acquisition method is adopted. The timing can be started after it is detected that the above parameters exceed the preset range of the exhaust parameter of the refrigerant leakage. In addition, the timing can also be started after it is detected that the exhaust temperature is greater than the preset exhaust temperature. For example, after it is detected that the exhaust temperature is greater than the preset exhaust temperature, the exhaust temperature of the compressor and the running current of the air conditioner are detected every one second. After it is detected that the exhaust temperature is greater than the exhaust temperature threshold and the running current is lower than the running current threshold, the refrigerant leakage detection function is triggered, and the current exhaust temperature of the air conditioner is acquired continuously. Accumulation of the timing continues, for example, the i-th second, and then acquire the exhaust temperature at the (i+1)th second, (i+2)th second, and so on. The time interval for timing acquisition can be any time, and are not limit in this embodiment.

The first determination module 20 is configured to determine the extreme value of the exhaust temperature of the air conditioner and the exhaust moment corresponding to the extreme value of the exhaust temperature according to the exhaust temperature at various moments.

The second acquisition module 30 is configured to acquire the exhaust period of the air conditioner according to the exhaust moment.

For example, the above extreme value of the exhaust temperature refers to the highest exhaust temperature or the lowest exhaust temperature during the fluctuation period of the exhaust temperature. For example, the exhaust temperature detected at the 152nd second is 123° C., the exhaust temperature detected at the 153rd second is 124° C., the exhaust temperature detected at 152 s is 123° C., and the exhaust temperature detected at 152 s is 122° C., 124° C. is the highest exhaust temperature.

In this embodiment, after acquiring the exhaust temperature at various moments, the extreme value of the exhaust temperature can be determined based on the exhaust difference value between the exhaust temperatures at two adjacent moments. For example, by determining the exhaust difference value between the exhaust temperature at the (i+1)th second and the exhaust temperature at the i-th second, it is possible to find the highest exhaust temperature or the lowest exhaust temperature and the exhaust moment corresponding to thereof. For example, after obtaining the exhaust temperature at various moments, if the exhaust difference value between the exhaust temperatures of two adjacent moments acquired for the first time is greater than zero, continue to acquire the exhaust difference value between the exhaust temperatures of the two subsequent adjacent moments until the exhaust difference value is equal to or less than zero, thus obtaining the highest exhaust temperature, and determining the exhaust moment corresponding to the highest exhaust temperature. If the exhaust difference value acquired for the first time is less than zero, continue to acquire the difference between the exhaust temperatures at two subsequent adjacent moments until the exhaust difference value is equal to or greater than zero, thus obtaining the lowest exhaust temperature, and determining the exhaust moment corresponding to the lowest exhaust temperature.

For ease of understanding, here is an example of the above steps. For example, after the exhaust temperature detected at the 152nd s is 123° C. and the exhaust temperature detected at the 153rd s is 124° C., the exhaust difference value between the 153rd s and the 152nd s is calculated as 1° C. Next, the exhaust temperature detected at the 154th s is 126° C., and the exhaust difference value between the 154th s and the 153rd s is calculated as 2° C. Next, the exhaust temperature detected at the 155th s is 125° C., and the exhaust difference value between the 155th s and the 154th s is calculated as (−1) ° C., which means that the highest exhaust temperature during the fluctuation period of the exhaust temperature is 126° C., and the exhaust moment corresponding to thereof is 154th s.

In addition, it should be noted that in this embodiment, it is necessary to acquire at least two highest exhaust temperatures or lowest exhaust temperatures to acquire the exhaust period. Here, the highest exhaust temperature is described as an example. When the exhaust difference value between the exhaust temperatures is acquired for the first time is greater than zero, continue to acquire the exhaust difference value between the exhaust temperatures at two subsequent adjacent moments until the exhaust difference value is equal to or less than zero, thereby obtaining a first highest exhaust temperature, and determining a first exhaust moment corresponding to the first highest exhaust temperature. Next, it continues to execute the above steps repeatedly, that is, after obtaining the first highest exhaust temperature, continue to obtain the exhaust difference value between the exhaust temperatures of the two subsequent adjacent timings until a second highest exhaust temperature is obtained based on the exhaust difference value, and determine a second exhaust moment corresponding to the second highest exhaust temperature. In addition, it should be noted that the exhaust temperature is flexibly variable, thus the highest exhaust temperature and the lowest exhaust temperature in each exhaust period are not a fixed value. Therefore, in this embodiment, the temperature values of the first highest exhaust temperature and the second highest exhaust temperature may be the same, or may be different. Finally, a time difference value between the first exhaust moment and the second exhaust moment is calculated to obtain the exhaust period.

In addition, in this embodiment, in addition to determining the extreme value of the exhaust temperature based on the exhaust difference value, an exhaust temperature trend curve of the air conditioner can also be generated based on the exhaust temperature at various moments, and the extreme value of the exhaust temperature can be determined based on the exhaust temperature trend curve.

The second determination module 40 is configured to determine whether there is the refrigerant leakage in the air conditioner based on the exhaust period.

In this embodiment, the above exhaust period can be used to reduce false alarms of the refrigerant leakage, thereby improving the accuracy of the refrigerant leakage. For example, when it is detected that the exhaust period of the exhaust temperature is shorter than the preset exhaust period, it is determined that there is a first-level refrigerant leakage in the air conditioner. When it is detected that the exhaust period of the exhaust temperature is greater than or equal to the preset exhaust period, it is determined that there is a second-level refrigerant leakage in the air conditioner.

In addition, in this embodiment, if there is the second-level refrigerant leakage in the air conditioner, the operating parameters of the air conditioner can be adjusted to enable the air conditioner to still have a certain cooling or heating effect, so as to not affect the normal use of the air conditioner. If there is the first-level refrigerant leakage in the air conditioner, it is necessary to immediately control the compressor of the air conditioner to shut down so as to protect the compressor and other equipment. In addition, a refrigerant leakage prompt message can also be output to remind the user that a refrigerant leakage failure in the air conditioner occurs.

In this embodiment, after it is detected that the air conditioner needs to trigger the refrigerant leakage detection function, the exhaust temperature of the air conditioner at various moments is acquired to determine the extreme value of the exhaust temperature of the air conditioner and the exhaust moment corresponding to thereof, thereby determining the exhaust period and detecting the refrigerant leakage based on the exhaust period. Therefore, the accurate exhaust period is obtained by determining the extreme value of the exhaust temperature of the air conditioner and the exhaust moment corresponding to thereof, and it is possible to reduce the false alarms for refrigerant leakage based on the accurate exhaust period, thereby improving the detection accuracy of the refrigerant leakage.

In addition, the embodiment of the present application also provide a computer-readable storage medium, on which a detection program for the refrigerant leakage is stored, and when the detection program for the refrigerant leakage is executed by one or more processors, the steps of the detection method for the refrigerant leakage as described above are implemented.

It should be noted that, as used herein, the terms "include", "comprise" or any other variation thereof are intended to cover a non-exclusive inclusion, such that a process, method, article or system that includes a list of elements not only includes those elements, but also includes other elements not expressly listed or elements that are inherent to the process, method, article or system. Without further limitation, an element defined by the statement "comprises a/an . . . " does not exclude the presence of other identical elements in the process, method, article, or system that includes that element.

The above serial numbers of the embodiments of the present application are only for description and do not represent the advantages or disadvantages of the embodiments.

Through the above description of the embodiments, those skilled in the art can clearly understand that the methods of the above embodiments can be implemented by means of software plus the necessary general hardware platform. Of course, it can also be implemented by hardware, but in many cases the former is a better implementation. Based on such understanding, the technical solution of the present application can be embodied in the form of a software product that is essentially or contributes to the existing technology. A computer software product is stored in the storage medium (such as, ROM/RAM, magnetic disk, optical disk) as mentioned above, including several instructions to cause a terminal device to execute the methods described in various embodiments of the present application.

The above descriptions are only preferred embodiments of the present application, and are not intended to limit the patent scope of the present application. Any equivalent structural or process transformations made using the contents of the description and drawings of the present application, or directly or indirectly application in other related art, are all equally included in the scope of the present application.

What is claimed is:

1. A refrigerant leakage detection method comprising:

acquiring an exhaust temperature of an air conditioner at a plurality of moments during a preset time period, in response to the exhaust temperature of the air conditioner being greater than a preset exhaust temperature and a target operating exhaust parameter of the air conditioner exceeding a preset range of the exhaust parameter of refrigerant leakage;

determining an extreme value of the exhaust temperature and an exhaust moment corresponding to the extreme value of the exhaust temperature of the air conditioner based on the exhaust temperature at the plurality of moments;

acquiring an exhaust period of the air conditioner based on the exhaust moment;

determining whether there is the refrigerant leakage in the air conditioner based on the exhaust period by:

determining that there is a second-level refrigerant leakage in the air conditioner, in response to that the exhaust period of the exhaust temperature is greater than or equal to a preset exhaust period; and after the determining that there is the second-level refrigerant leakage in the air conditioner, decreasing an operating frequency of a compressor of the air conditioner and increasing an opening of an outdoor electronic expansion valve of the air conditioner.

2. The refrigerant leakage detection method of claim 1, wherein the determining the extreme value of the exhaust temperature of the air conditioner based on the exhaust temperature at the plurality of moments comprises:

determining an exhaust difference value between the exhaust temperatures at two adjacent moments of the plurality of moments; and determining the extreme value of the exhaust temperature of the air conditioner based on the exhaust difference value.

3. The refrigerant leakage detection method of claim 1, wherein after the decreasing the operating frequency of the compressor of the air conditioner and increasing the opening of the outdoor electronic expansion valve of the air conditioner, the refrigerant leakage detection method further comprises:

controlling the air conditioner to restart, and acquiring the target operating exhaust parameters of the air conditioner; and controlling the compressor of the air conditioner to shut down and outputting a refrigerant leakage prompt message, in response to detecting that the target operating exhaust parameters exceed a preset parameter range of refrigerant leakage detection.

4. The refrigerant leak detection method of claim 3, wherein after the acquiring the target operating exhaust parameter of the air conditioner, the refrigerant leakage detection method further comprises:

decreasing the operating frequency of the compressor of the air conditioner and increasing the opening of the outdoor electronic expansion valve of the air conditioner, in response to detecting that the target operating exhaust parameter does not exceed the preset parameter range of the refrigerant leakage detection.

5. The refrigerant leakage detection method of claim 1, wherein the acquiring the exhaust temperature of the air conditioner at the plurality of moments during the preset time period, in response to the exhaust temperature of the air conditioner being greater than the preset exhaust temperature and the target operating exhaust parameter of the air conditioner exceeding the preset range of the exhaust parameter of refrigerant leakage comprises:

adjusting an operation state of the air conditioner and acquiring the target operating exhaust parameter of the air conditioner operated in the adjusted operation state, in response to that the exhaust temperature of the air conditioner is greater than the preset exhaust temperature; and acquiring the exhaust temperature of the air conditioner at the plurality of moments during the preset time period, in response to that the target operating exhaust parameter of the air conditioner exceeds the preset range of the exhaust parameter of refrigerant leakage.

6. An air conditioner, comprising:

one or more processors, and a memory, wherein a refrigerant leakage detection program is stored in the memory, and wherein when the refrigerant leakage detection program is executed by the one or more processors, the refrigerant leakage detection method according to claim 1 is implemented.

7. A non-transitory computer-readable storage medium, wherein a refrigerant leakage detection program is stored on the non-transitory computer-readable storage medium, and the refrigerant leakage detection method according to claim 1 is implemented when the refrigerant leakage detection program is executed by one or more processors.

8. A refrigerant leakage detection device comprising:

one or more processors configured to:

acquire an exhaust temperature of an air conditioner at a plurality of moments during a preset time period, in response to the exhaust temperature of the air conditioner being greater than a preset exhaust temperature and a target operating exhaust parameter of the air conditioner exceeding a preset range of the exhaust parameter of refrigerant leakage;

determine an extreme value of the exhaust temperature and an exhaust moment corresponding to the extreme value of the exhaust temperature of the air conditioner based on the exhaust temperature at the plurality of moments;

acquire an exhaust period of the air conditioner based on the exhaust moment;

determine whether there is a refrigerant leakage in the air conditioner based on the exhaust period, by:

determining that there is a second-level refrigerant leakage in the air conditioner, in response to that the exhaust period of the exhaust temperature is greater than or equal to a preset exhaust period; and after the determining that there is the second-level refrigerant leakage in the air conditioner, decreasing an operating frequency of a compressor of the air conditioner and increasing an opening of an outdoor electronic expansion valve of the air conditioner.

9. A refrigerant leakage detection method comprising:

acquiring an exhaust temperature of an air conditioner at a plurality of moments during a preset time period, in response to the exhaust temperature of the air conditioner being greater than a preset exhaust temperature and a target operating exhaust parameter of the air conditioner exceeding a preset range of the exhaust parameter of refrigerant leakage;

determining an extreme value of the exhaust temperature and an exhaust moment corresponding to the extreme value of the exhaust temperature of the air conditioner based on the exhaust temperature at the plurality of moments;

acquiring an exhaust period of the air conditioner based on the exhaust moment;

determining whether there is the refrigerant leakage in the air conditioner based on the exhaust period, by determining that there is a first-level refrigerant leakage in the air conditioner, in response to that the exhaust period of the exhaust temperature is less than a preset exhaust period; and after the determining that there is the first-level refrigerant leakage in the air conditioner, controlling the compressor of the air conditioner to stop and outputting a refrigerant leakage prompt message.

* * * * *